US010046572B2

(12) United States Patent
Fukuda

(10) Patent No.: US 10,046,572 B2
(45) Date of Patent: Aug. 14, 2018

(54) DATA GENERATION METHOD, COMPUTER-READABLE STORAGE MEDIUM, AND STRUCTURE MANUFACTURING METHOD

(71) Applicant: CASIO COMPUTER CO., LTD., Tokyo (JP)

(72) Inventor: Kunio Fukuda, Mizuho-machi (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/905,132

(22) Filed: Feb. 26, 2018

(65) Prior Publication Data

US 2018/0186156 A1 Jul. 5, 2018

Related U.S. Application Data

(63) Continuation of application No. 15/435,420, filed on Feb. 17, 2017.

(30) Foreign Application Priority Data

Mar. 22, 2016 (JP) ..... 2016-057209

(51) Int. Cl.
*B41M 3/00* (2006.01)
*B41J 11/00* (2006.01)
(Continued)

(52) U.S. Cl.
CPC ..... *B41J 11/002* (2013.01); *B41J 2/2103* (2013.01); *B41J 3/32* (2013.01); *B41M 3/00* (2013.01); *B41J 3/60* (2013.01)

(58) Field of Classification Search
CPC . B41J 11/002; B41J 2/2103; B41J 3/32; B41J 3/60; B41M 3/00
See application file for complete search history.

(56) References Cited

U.S. PATENT DOCUMENTS 8,870,327 B2 10/2014 Kanamura et al.
9,492,956 B2 11/2016 Horiuchi
(Continued)

FOREIGN PATENT DOCUMENTS

CN 103171318 A 6/2013
CN 103182873 A 7/2013
(Continued)

OTHER PUBLICATIONS

US Office Action dated Sep. 15, 2017 received in related U.S. Appl. No. 15/435,420.
(Continued)

*Primary Examiner* — Huan Tran
(74) *Attorney, Agent, or Firm* — Scully, Scott, Murphy & Presser, P.C.

(57) ABSTRACT

A first pattern P1 is formed with a first material for converting electromagnetic wave energy into heat energy, on a first surface BS of a print medium M including an expansion layer M2 that expands by heating. A second pattern P2 for expanding the expansion layer M2 to complement expansion of the expansion layer M2 by the first pattern P1 is formed with a second material for converting electromagnetic wave energy into heat energy, on a second surface FS which is an opposite surface of the print medium M to the first surface BS and is closer to the expansion layer M2 than the first surface BS. The first material forming the first pattern P1 is irradiated with electromagnetic waves from the first surface BS. The second material forming the second pattern P2 is irradiated with electromagnetic waves from the second surface FS.

16 Claims, 6 Drawing Sheets

(51) Int. Cl.

| | |
|---|---|
| ***B41J 3/32*** | (2006.01) |
| ***B41J 2/21*** | (2006.01) |
| *B41J 3/60* | (2006.01) |

(56) References Cited

U.S. PATENT DOCUMENTS

| | | | | |
|---|---|---|---|---|
| 9,522,490 | B2 | 12/2016 | Horiuchi et al. | |
| 9,579,833 | B2 | 2/2017 | Horiuchi | |
| 2012/0218338 | A1 | 8/2012 | Kanamura et al. | |
| 2013/0161874 | A1 | 6/2013 | Horiuchi | |
| 2013/0229478 | A1 | 9/2013 | Horiuchi | |
| 2013/0280498 | A1 | 10/2013 | Horiuchi et al. | |
| 2014/0110887 | A1 | 4/2014 | Horiuchi | |
| 2016/0075083 | A1 | 3/2016 | Motoyanagi | |
| 2017/0144339 | A1 | 5/2017 | Horiuchi | |
| 2017/0195522 | A1* | 7/2017 | Suzuki | H04N 1/4072 |
| 2017/0274672 | A1* | 9/2017 | Fukuda | B41J 2/2103 |

FOREIGN PATENT DOCUMENTS

| | | | |
|---|---|---|---|
| JP | H08-118780 | A | 5/1996 |
| JP | 2001-150812 | A | 6/2001 |
| JP | 2012-171317 | A | 9/2012 |
| JP | 2013-132765 | A | 7/2013 |
| JP | 2013-136171 | A | 7/2013 |
| JP | 2014-081582 | A | 5/2014 |
| JP | 2015-071286 | A | 4/2015 |

OTHER PUBLICATIONS

Notification of Reasons for Refusal dated May 22, 2018 received in Japanese Patent Application No. JP 2016-057209 together with an English language translation.

* cited by examiner

| HEIGHT H | LENGTH L | DATA LENGTH | GRAY SCALE DATA |
|---|---|---|---|
| 0.5mm | 0.7mm | n | d1,d2,d3,···,dn |
| 0.6mm | 0.8mm | m | d1,d2,d3,···,dm |
| 0.7mm | 0.9mm | l | d1,d2,d3,···,dl |
| ⋮ | ⋮ | ⋮ | |
| ⋮ | ⋮ | ⋮ | |
| 2.0mm | 2.4mm | x | d1,d2,d3,···,dx |

DATA GENERATION METHOD, COMPUTER-READABLE STORAGE MEDIUM, AND STRUCTURE MANUFACTURING METHOD

CROSS-REFERENCE TO RELATED APPLICATIONS

This application is a continuation application of U.S. patent application Ser. No. 15/435,420 filed on Feb. 17, 2017, which is based upon and claims the benefit of priority from Japanese Patent Application No. 2016-057209, filed on Mar. 22, 2016, the entire contents of which are incorporated herein by reference.

BACKGROUND OF THE INVENTION

1. Field of the Invention

The present invention relates to a data generation method, a computer-readable storage medium, and a structure manufacturing method.

2. Description of the Related Art

As one of the three-dimensional structure manufacturing techniques, a technique of printing, in black ink or toner, a desired pattern on a print medium including an expansion layer that expands by heating and then irradiating the print medium uniformly with light is known. This technique utilizes the property that a region printed in black ink or toner has higher heat absorptivity and is heated to a higher temperature than a region not printed in black ink or toner, and causes the region printed in black ink or toner to expand and rise. Japanese Patent Application Laid-Open No. 2012-171317 describes a three-dimensional printer using this technique.

A three-dimensional structure can not only provide visual information but also provide tactile information to a person who touches the structure. Therefore, the aforementioned technique for manufacturing a three-dimensional structure using printing technology is widely expected to be used in the fields such as braille and tactile graphics.

SUMMARY OF THE INVENTION

In the aforementioned technique, the height of the formed structure is designated by print density. However, the aforementioned technique has a problem in that, even though a predetermined region is printed in uniform density, the height of the structure formed in the region is not uniform and the edge part of the structure is not sharp. This makes it difficult to manufacture a structure of a desired shape.

In view of such circumstances, the present invention has an object of providing a technique for manufacturing a three-dimensional structure of a desired shape on a print medium.

A data generation method for generating shading pattern data of a density of a material for converting electromagnetic wave energy into heat energy includes: acquiring image data of a first density image which is a first pattern to be formed with the material on a first surface of a print medium including an expansion layer that expands by heating; and generating image data of a second density image which is a second pattern formed with the material on a second surface which is an opposite surface of the print medium to the first surface and is closer to the expansion layer than the first surface, based on the image data of the first density image and identification information of the print medium.

A computer-readable storage medium for controlling a data generation apparatus including a control unit includes: a process of acquiring image data of a first density image which is a first pattern to be formed with a material for converting electromagnetic wave energy into heat energy on a first surface of a print medium including an expansion layer that expands by heating; and a process of generating image data of a second density image which is a second pattern formed with the material on a second surface which is an opposite surface of the print medium to the first surface and is closer to the expansion layer than the first surface, based on the image data of the first density image and identification information of the print medium.

A structure manufacturing method for manufacturing a structure by expanding an expansion layer that is included in a print medium and expands by heating includes: forming a first pattern with a first material for converting electromagnetic wave energy into heat energy, on a first surface of the print medium; forming a second pattern with a second material for converting electromagnetic wave energy into heat energy, on a second surface which is an opposite surface of the print medium to the first surface and is closer to the expansion layer than the first surface, the second pattern being a pattern for expanding the expansion layer to complement expansion of the expansion layer by the first pattern; irradiating the print medium with electromagnetic waves from the first surface; and irradiating the print medium with electromagnetic waves from the second surface.

According to the present invention, it is possible to provide a technique for manufacturing a three-dimensional structure of a desired shape on a print medium.

DETAILED DESCRIPTION OF THE INVENTION

Figure 1:
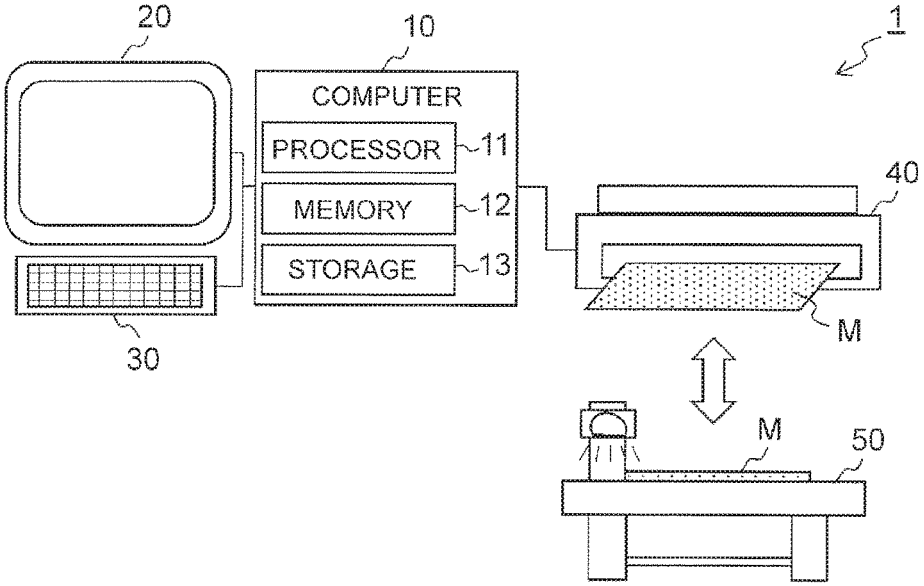
FIG. 1 is a diagram illustrating the configuration of a structure manufacturing system 1.
Figure 2:
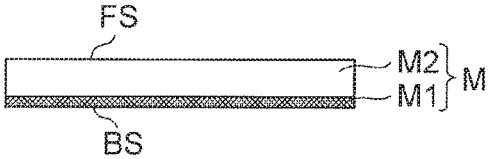
FIG. 2 is a diagram illustrating the configuration of a print medium M.
Figure 3:
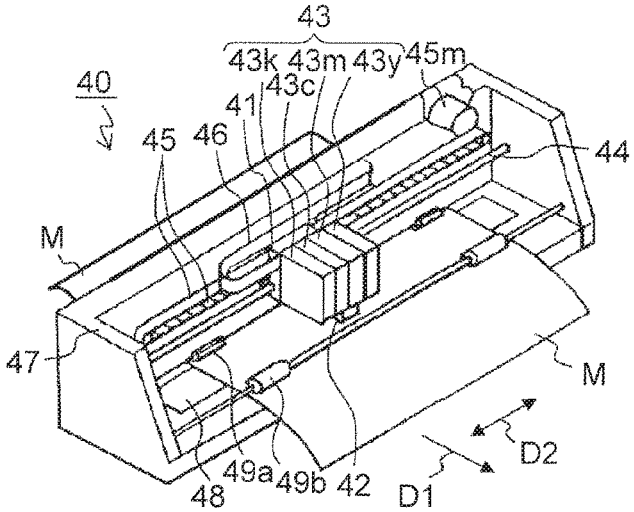
FIG. 3 is a diagram illustrating the configuration of a printer 40.
Figure 4:
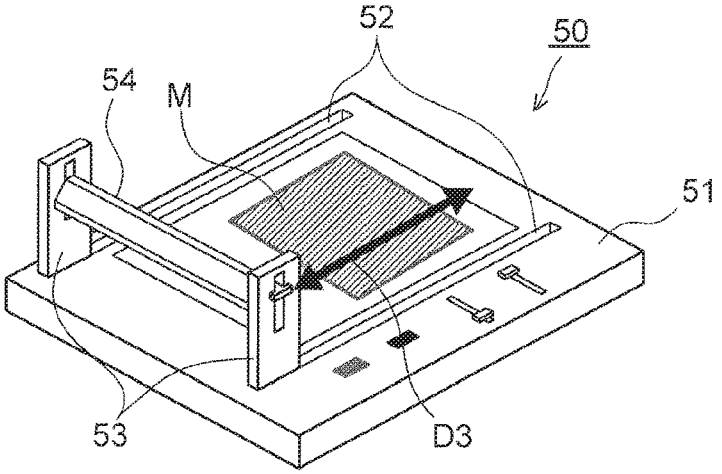
FIG. 4 is a diagram illustrating the configuration of a heater 50.

FIG. 1 is a diagram illustrating the configuration of a structure manufacturing system 1. FIG. 2 is a diagram illustrating the configuration of a print medium M. FIG. 3 is a diagram illustrating the configuration of a printer 40. FIG. 4 is a diagram illustrating the configuration of a heater 50.

The structure manufacturing system 1 includes a computer 10, a display device 20, an input device 30, the printer 40, and the heater 50, as illustrated in FIG. 1. The structure manufacturing system 1 forms a shading pattern which is a density image generated by the computer 10 on the print medium M including an expansion layer by the printer 40, and heats the print medium M with the shading pattern formed thereon by the heater 50 to manufacture a three-dimensional structure on the print medium M. The structure manufacturing system 1 further forms a color pattern which is a color image generated by the computer 10 on the print medium M by the printer 40, thus manufacturing a colored three-dimensional structure.

The print medium M is a thermal expansion sheet having a multilayer configuration in which an expansion layer M2 is stacked on a base material M1, as illustrated in FIG. 2. The expansion layer M2 is a layer of thermoplastic resin containing countless microcapsules that expand by heating, and expands according to the amount of heat absorbed. The base material M1 is made of, for example, paper, cloth such as canvas, or a panel material such as plastic, although the material is not particularly limited. A black shading pattern is formed on the surface FS of the print medium M and the surface BS of the base material M1 by the printer, as described later. The surface FS is also referred to as a second surface, as the below-mentioned second pattern is formed on the surface FS. The surface BS is also referred to as a first surface, as the below-mentioned first pattern is formed on the surface BS. The surface BS and the surface FS can be regarded as the opposite surfaces of the print medium M.

A shading pattern by area coverage modulation is formed directly on or in proximity to the surface of the expansion layer M2 using an electromagnetic wave-heat conversion material (e.g. ink of black K including carbon black), as described later. Electromagnetic wave energy applied to the electromagnetic wave-heat conversion material is absorbed by the material, and converted into heat energy. In a part of the expansion layer M2 where the pattern is formed with the electromagnetic wave-heat conversion material, electromagnetic wave-heat energy conversion is performed more efficiently than in a part of the expansion layer M2 where the pattern is not formed with the electromagnetic wave-heat conversion material. The heat energy generated in this way is transferred to mainly heat the part of the expansion layer M2 where the pattern is formed with the electromagnetic wave-heat conversion material, as a result of which the expansion layer M2 expands in the shape corresponding to the pattern formed with the electromagnetic wave-heat conversion material. Here, by forming the pattern to include shading by area coverage modulation using the electromagnetic wave-heat conversion material on the expansion layer M2, more heat energy is transferred in the part with higher formation density of the electromagnetic wave-heat conversion material than in the part with lower formation density of the electromagnetic wave-heat conversion material, thus expanding the expansion layer M2 to a greater height. In this specification, forming a pattern with a substance on the surface of the expansion layer M2 means to form the pattern with the substance directly on or in proximity to the surface.

The computer 10 is a computing unit including a processor 11, memory 12, and a storage 13, as illustrated in FIG. 1. The computer 10 generates image data through the execution of a program by the processor 11, and outputs print data corresponding to the image data to the printer 40. The display device 20 is, for example, a liquid crystal display, an organic electroluminescent (EL) display, or a cathode ray tube (CRT) display, and displays an image according to a signal from the computer 10. The input device 30 is, for example, a keyboard, a mouse, etc., and outputs a signal to the computer 10.

The printer 40 is an inkjet printer that prints the print medium M based on input print data. The printer 40 includes a carriage 41 capable of reciprocating in the direction (main scan direction D2) indicated by the two-headed arrow orthogonal to the medium conveyance direction (sub-scan direction D1), as illustrated in FIG. 3. A print head 42 for executing printing and ink cartridges 43 (43*k*, 43*c*, 43*m*, 43*y*) storing ink are attached to the carriage 41. The cartridges 43*k*, 43*c*, 43*m*, and 43*y* respectively store color inks of black K, cyan C, magenta M, and yellow Y. The ink of each color is ejected from a corresponding nozzle of the print head 42.

The ink of black K includes carbon black as the electromagnetic wave-heat conversion material in some cases, and does not include carbon black in other cases. In the case of forming a density image (gray scale image) on the surface of the expansion layer M2 using the ink of black K including carbon black, heat energy generated by irradiating the image with electromagnetic waves is transferred to expand the expansion layer M2. In the case of forming the same density image with the ink of black K not including carbon black or a color mixture of color inks of cyan C, magenta M, and yellow Y, on the other hand, no heat energy is generated when irradiating the density image with electromagnetic waves, so that the part of the expansion layer M2 where the density image is formed does not expand.

The carriage 41 is slidably supported by a guide rail 44, and sandwiched by a drive belt 45. When the drive belt 45 is driven by rotating a motor 45*m*, the carriage 41 moves in the main scan direction D2 together with the print head 42 and the ink cartridges 43. A platen 48 extending in the main scan direction D2 is placed in the lower part of a frame 47 at the position facing the print head 42. Moreover, a feed roller pair 49*a* (the lower roller is not illustrated) and a discharge roller pair 49*b* (the lower roller is not illustrated) are arranged to convey the print medium M supported on the platen 48 in the sub-scan direction D1.

A control unit of the printer 40 connected to the print head 42 via a flexible communication cable 46 controls the motor 45*m*, the print head 42, the feed roller pair 49*a*, and the discharge roller pair 49*b*, based on print data and print control data from the computer 10. Thus, at least a shading pattern is formed on the print medium M, and a color pattern is further formed on the print medium M if necessary. In other words, at least the aforementioned density image is formed, and the color image is further printed if necessary. In the case where there is no need to expand the expansion layer M2, only the color pattern may be formed on the expansion layer M2 without forming the shading pattern.

The shading pattern is an image formed on the surface of the expansion layer M2 so that, when the formed image is irradiated with electromagnetic waves, the expansion layer M2 is expanded to a desired height by heating to obtain a desired structure. Thus, the term "shading pattern" in this specification means an image formed on the surface of the expansion layer M2 using the aforementioned electromagnetic wave-heat conversion material, and does not mean an image including shading formed using a material not containing the electromagnetic wave-heat conversion material. At least a part of the color image may be formed using the electromagnetic wave-heat conversion material. However, when electromagnetic waves are applied after the formation of such a color image, the expansion layer M2 expands over the desired height intended by the formation of the shading pattern, as described in detail later. It is therefore desirable to avoid irradiating the surface of the expansion layer M2 where the color image is formed with electromagnetic waves, after the formation of the color image.

The heater 50 is a device that heats the print medium M by irradiating it with electromagnetic waves. The heater 50 includes a placement table 51 having guide grooves 52, a support 53 supporting a light source unit 54, and the light source unit 54 including a light source, as illustrated in FIG. 4. The print medium M with a shading pattern formed thereon is placed on the placement table 51. The support 53 is configured to slide along the guide grooves 52. The light source in the light source unit 54 emits electromagnetic waves.

In the heater 50, the light source unit 54 moves in the direction D3 together with the support 53 while emitting electromagnetic waves, to irradiate the print medium M uniformly with the electromagnetic waves. In the region in which the shading pattern is printed, the electromagnetic waves are efficiently absorbed and converted into heat energy, as mentioned earlier. Thus, the region corresponding to the shading pattern is heated and expands to manufacture the three-dimensional structure corresponding to the shading pattern.

In the case where the shading pattern is printed in the ink of black K including carbon black, the electromagnetic waves desirably include infrared wavelengths. The wavelength range of the electromagnetic waves is, however, not particularly limited as long as heat is more efficiently absorbed for heating in the region printed in the ink used for shading pattern formation than in the region not printed in the ink. The ink used for shading pattern formation includes at least a material for absorbing electromagnetic waves and converting them into heat.

Figure 5:
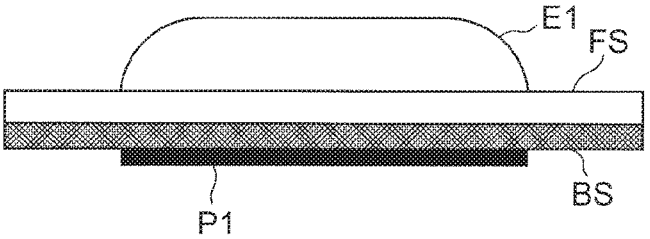
FIG. 5 is a diagram illustrating a three-dimensional structure manufactured by a conventional three-dimensional structure manufacturing system.

FIG. 5 is a diagram illustrating a three-dimensional structure formed by a conventional three-dimensional structure manufacturing system. As mentioned earlier, in the conventional structure manufacturing system, even though a first pattern P1 which is a shading pattern entirely of uniform density is formed on the surface BS of the print medium M and electromagnetic waves are applied, a structure having a uniform height throughout the region where the first pattern P1 is formed is not formed, and a structure E1 whose edge part is not sharp is formed as illustrated in FIG. 5. The cross-sectional shape of such a structure E1 has a smaller curvature in the boundary region of the first pattern P1, that is, in the peripheral edge (outline). This is more noticeable in the case where the first pattern P1 is formed on the surface BS farther from the expansion layer M2 in order to prevent black ink from remaining on the surface of the three-dimensional structure, than in the case where the first pattern P1 is formed on the surface FS of the expansion layer M2. In this specification, the cross-sectional shape refers to the planar shape of the structure E1 cut along a plane approximately orthogonal to the peripheral edge of the first pattern P1.

Figure 6A:
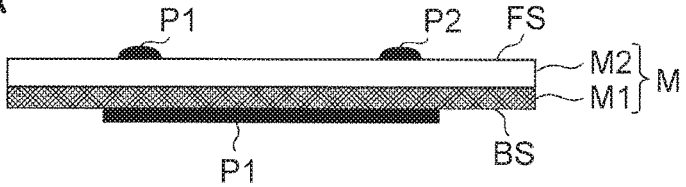
FIG. 6A and FIG. 6B are diagrams illustrating a three-dimensional structure manufactured by the structure manufacturing system 1.
Figure 6B:
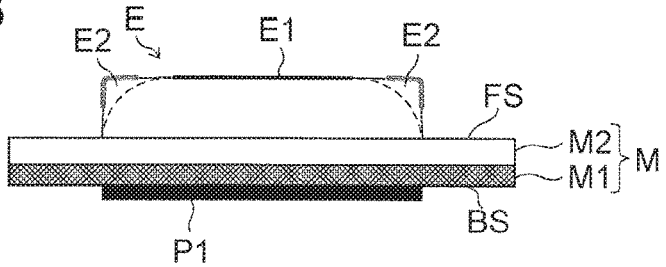
Figure 7A:
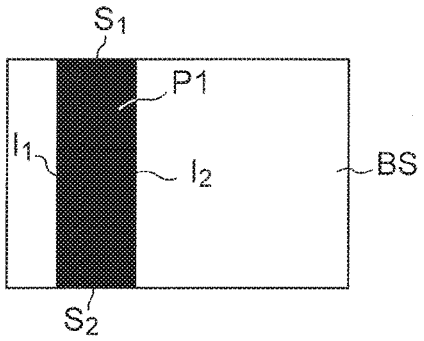
FIG. 7A and FIG. 7B are diagrams illustrating a first pattern P1 and a second pattern P2.
Figure 7B:
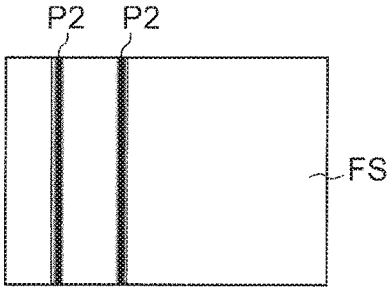

In anticipation of such a phenomenon that, even though the first pattern P1 of uniform density as illustrated in FIG. 7A is formed on the print medium M (surface BS, first surface), a structure whose edge part is not sharp in its boundary region is formed, in the structure manufacturing system 1, a second pattern P2 for expanding the expansion layer M2 so as to complement the expansion of the expansion layer M2 by the first pattern P1 is formed on the surface FS (second surface) which is the opposite surface to the surface BS and is closer to the expansion layer M2 than the surface BS, as illustrated in FIGS. 6A and 7B. In more detail, the second pattern P2 is a pattern that complements the difference between the shape of the structure to be formed as specified by the first pattern P1 and the shape of the structure formed by expanding the expansion layer M2 through irradiation with electromagnetic waves from the surface BS. As a result, a desired structure E entirely having an approximately uniform height can be formed as illustrated in FIG. 6B, as the edge part of the structure E is complemented by a structure E2 (the part of the structure E outside the dashed line in the cross-sectional shape in FIG. 6B) corresponding to the second pattern P2. In other words, by complementing the structure E1 by the structure E2, the desired structure E entirely having an approximately uniform height can be formed (the edge part of the structure E corresponds to the structure E2).

In other words, the second pattern P2 is a pattern for increasing the curvature (i.e. reducing the radius of curvature) of the cross-sectional shape in the part corresponding to the boundary region of the first pattern P1 in the structure E to be manufactured, for making the angular part of the cross-sectional shape closer to the right angle, or for making the edge part of the structure E sharper, as compared with the case where the first pattern P1 is formed on the surface BS of the base material M1 and the second pattern P2 is not formed on the surface FS of the expansion layer M2. Thus, the second pattern P2 is particularly effective in improving the cross-sectional shape in the boundary region of the first pattern P1, i.e. expanding the structure E to the desired height even in the boundary region.

The second pattern P2 is a pattern for complementing the first pattern P1, and so is formed in a narrower range than the first pattern P1 as illustrated in FIG. 7B. This reduces adverse effect caused by black ink remaining on the surface of the three-dimensional structure.

Figure 8A:
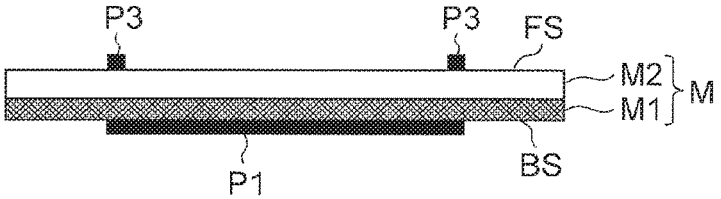
FIG. 8A and FIG. 8B are diagrams illustrating a three-dimensional structure that can be manufactured by a conventional three-dimensional structure manufacturing system.
Figure 8B:
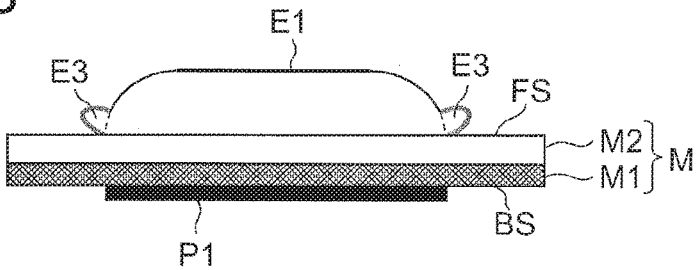

In the case where the shading pattern formed on the surface FS is not the second pattern P2 for complementing the first pattern P1, the desired structure E is not formed as illustrated in FIGS. 8A and 8B. This is because a structure E3 corresponding to a pattern (third pattern P3) formed without taking into account the density of the first pattern P1, the print medium M, and the like does not have such a shape that complements the edge part of the structure having the desired shape.

Figure 9:
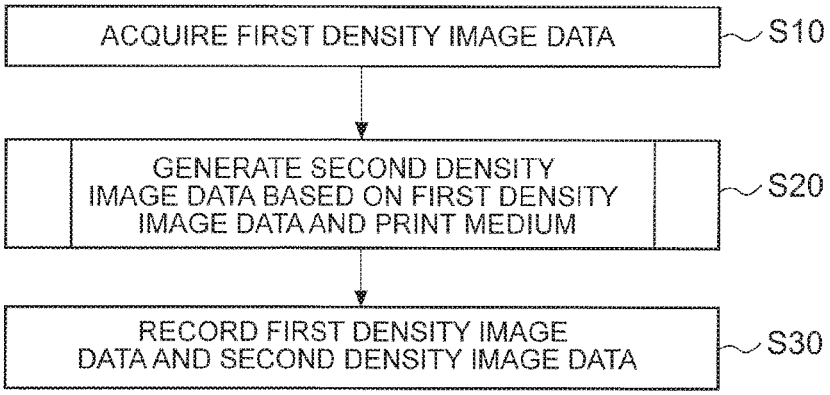
FIG. 9 is a flowchart of an image data generation process.
Figure 10:
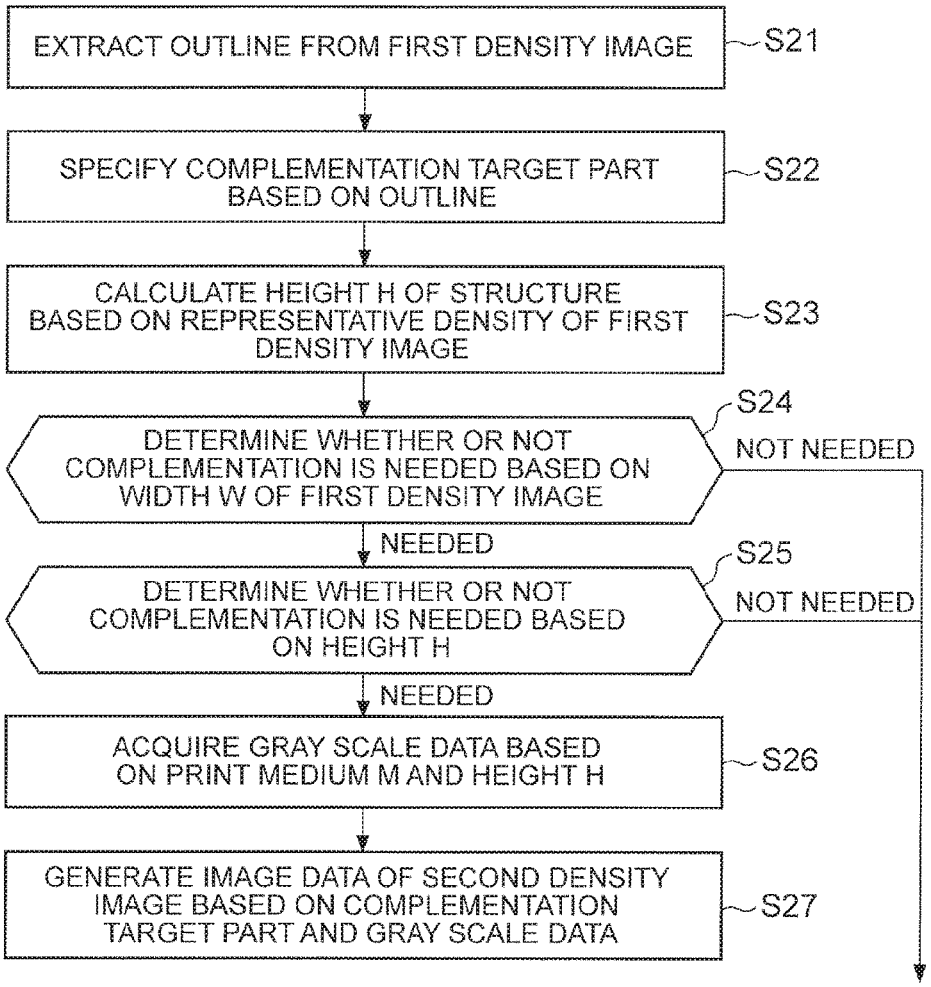
FIG. 10 is a flowchart of a second density image data generation process.
Figure 11:
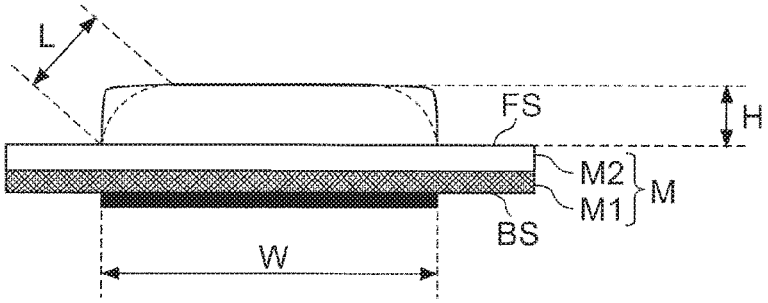
FIG. 11 is a diagram for describing the shape of a structure formed by the first pattern P1.
Figure 12:
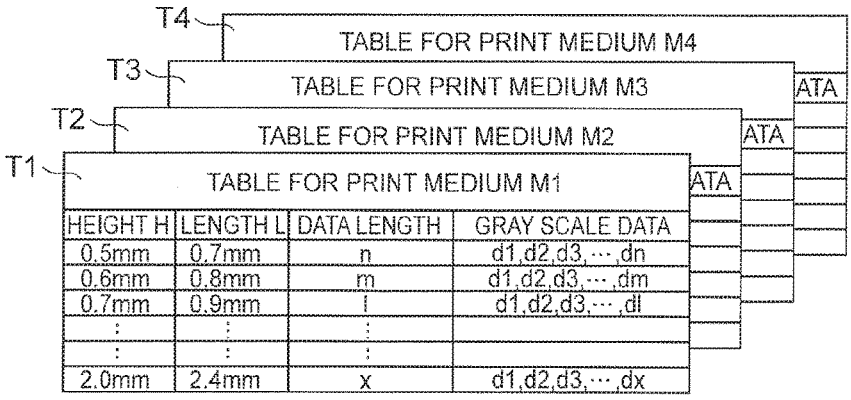
FIG. 12 is a diagram illustrating the configuration of prestored data referenced in the second density image data generation process.

The following describes a method of generating image data of the first pattern P1 and second pattern P2 in detail, with reference to FIGS. 9 to 12. FIG. 9 is a flowchart of an image data generation process. FIG. 10 is a flowchart of a second density image data generation process. FIG. 11 is a diagram for describing the shape of a structure formed by the first pattern P1. FIG. 12 is a diagram illustrating the configuration of prestored data referenced in the second density image data generation process. The first pattern P1 and the second pattern P2 are each a shading pattern formed in black ink K, and is a density image. Hence, the first pattern P1 and the second pattern P2 are hereafter also referred to as a first density image and a second density image, respectively.

The image data generation process in FIG. 9 is, for example, performed by the computer 10 executing an image generation program. First, the computer 10 acquires the image data of the first density image (hereafter referred to as first density image data) (step S10). In step S10, for example, the computer 10 may acquire the first density image data by generating the first density image data from information input by the user using the input device 30, or acquire the first density image data from an external device (not illustrated).

The first pattern P1 (first density image) is obtained by substituting, by a shading pattern, the shape of the structure to be formed, and the shape of the structure to be formed on the print medium M is specified by the first pattern P1. The following describes an example where the computer 10 acquires the first density image data representing the first pattern P1 which is a shading pattern entirely of uniform density as illustrated in FIG. 7A, for simplicity's sake.

Having acquired the first density image data, the computer 10 generates the second density image data based on the acquired first density image data and the print medium M on which the first pattern P1 is formed (step S20). The second density image data is the image data of the second density image which is the second pattern P2 for complementing the first pattern P1.

When the second density image data generation process in FIG. 10 starts, the computer 10 extracts the outline from the first density image (step S21). For example, in the case where the first density image is the pattern P1 illustrated in FIG. 7A, the rectangular outline is extracted.

Having extracted the outline, the computer 10 specifies a complementation target part based on the extracted outline (step S22). For example, since there is little need to complement the part forming the outline of the print medium M (the ends of the print medium M), the computer 10 specifies a part not forming the outline of the print medium M as the complementation target part. This saves any unnecessary complementation process. Of the rectangular outline of the pattern P1 illustrated in FIG. 7A, the part extending along two long sides 11 and 12, which does not form the outline of the print medium M, is specified as the complementation target part here. If necessary, the part extending along two short sides s1 and s2, which forms the outline of the print medium M, may also be included in the complementation target part. The complementation target part is included at least in the aforementioned uniform density region. In this example, the complementation target part has a long and thin rectangular shape extending along each of the two long sides 11 and 12 as illustrated in FIG. 7B. Note that the outline (s1 and s2) of the print medium M is the ends (edges) of the print region and the ends (edges) of the paper, and the two long sides 11 and 12 which do not form the outline of the print medium M are the borders between the print region (pattern P1) and the non-print region (the region other than the pattern P1).

Having specified the complementation target part, the computer 10 calculates the height H of the structure to be formed, based on the representative density of the first density image (step S23). The representative density is, for example, the density of the complementation target part in the first density image. The relationship between the height H and the density is known for each print medium M, and so the height H is calculated based on the known relationship in step S23.

Having calculated the height H, the computer 10 determines whether or not complementation is needed, based on the width W of the first density image (step S24). For example, the computer 10 may determine that complementation is not needed in the case where the width W of the first density image is less than a predetermined width. The computer 10 may determine that complementation is needed in the case where the width W of the first density image is greater than or equal to the predetermined width. The computer 10 may determine whether or not complementation is needed, based on the width W and the height H. In the case where the first pattern P1 entirely has uniform density, there is a predetermined correlation between the height H of the structure formed by the first pattern P1 and the length L of its edge part, as illustrated in FIG. 11. For example, the computer 10 may determine that complementation is not needed in the case where the condition $2L<W$ is not satisfied, because the region of the height H of the structure formed by the first pattern P1 is too narrow. The computer 10 may determine that complementation is needed in the case where the condition $2L<W$ is satisfied.

Having determined that complementation is needed based on the width W, the computer 10 further determines whether or not complementation is needed based on the height H (step S25). Here, the computer 10 determines whether or not the height H calculated in step S23 is greater than or equal to a predetermined height (e.g. 0.5 mm). In the case where the height H is too low, the computer 10 determines that complementation is not needed, because there is little effect of complementation. In the case where the height H is greater than or equal to the predetermined height (e.g. 0.5 mm), the computer 10 determines that complementation is needed.

In the case where the computer 10 determines that complementation is not needed in step S24 or S25, the computer 10 ends the second density image data generation process without generating the second density image data.

Having determined that complementation is needed based on the height H, the computer 10 acquires gray scale data based on the print medium M and the height H (step S26). The gray scale data is data representing a density distribution for complementing the edge part, and is prestored in the storage 13 of the computer 10 for each combination of the print medium M and the height H. The computer 10 acquires the corresponding gray scale data from the storage 13, based on the print medium M and the height H calculated in step S23.

The storage 13 includes a table (as identification information of the print medium) for each type of print medium M (tables T1 to T4 corresponding to print media M1 to M4 in this example), as illustrated in FIG. 12. Each table stores the length L of the edge part, data length, and gray scale data for each height H of the structure. The data length is the number of pixels (the number of dots) subjected to printing in the complementation target part by the printer 40. The gray scale data is data made up of gray scale levels for the data length. The gray scale data has such a gray scale level distribution in which the gray scale level is highest at an approximately central pixel (e.g. the n/2-th pixel when the gray scale data is made up of gray scale levels of n pixels) and decreases outward from the center. For example, an experiment or the like is performed for each combination of the print medium M and the height H beforehand to determine a shading pattern that can complement the edge part, and the gray scale data is determined based on the shading pattern and recorded in the storage 13.

Having acquired the gray scale data, the computer 10 generates the second density image data based on the complementation target part specified in step S22 and the gray scale data acquired in step S26 (step S27). Here, the computer 10 first selects the pixels constituting the long sides 11 and 12 forming the outline of the rectangular complementation target part one by one. The computer 10 assigns, for each selected pixel, the gray scale level included in the gray scale data on a pixel basis toward the inside of the ring (toward the inside of the first pattern P1) in the direction orthogonal to the long sides 11 and 12 from the pixel. In detail, in the case where the data length of the acquired gray scale data is n, gray scale levels are assigned to n pixels toward the inside of the rectangular region. The computer 10 repeatedly performs this process for all pixels in the complementation target part, to generate the second density image data. Although the outline of the complementation target part is a straight line in this example, the same process can also be performed in the case where the outline is a curved line. In such a case, if a plurality of density values (gray scale levels) correspond to one pixel, for example the average of the plurality of density values may be set as the density value of the pixel. If no density value corresponds to one pixel, the average of its neighboring pixels may be set as the density value of the pixel.

Having generated the second density image data, the computer 10 records the first density image data acquired in step S10 and the second density image data generated in step S20 (step S30), and ends the image data generation process in FIG. 9.

With the image data generation process in FIG. 9, it is possible to calculate the second pattern P2 for complementing the difference between the shape of the structure to be formed as specified by the first pattern P1 and the shape of the structure formed by the first pattern P1, and generate and record the second density image data representing the second pattern P2.

Figure 13A:
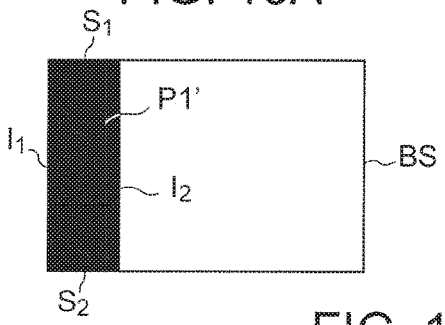
FIG. 13A and FIG. 13B are diagrams illustrating a first pattern P1' and a second pattern P2'.
Figure 13B:
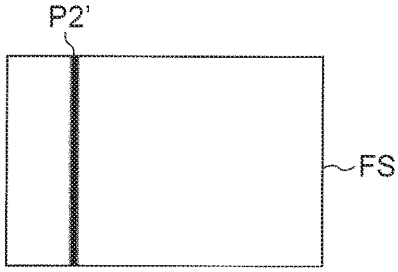

While the above describes an example where there are two complementation target parts, the number of complementation target parts may be one or more, and the second pattern is desirably a pattern corresponding to at least a part of the outline of the first pattern. For example, in the case where the first density image is a pattern P1' illustrated in FIG. 13A, the complementation target part specified in step S22 is only one side of the outline of the rectangle. In such a case, second density image data representing a pattern P2' illustrated in FIG. 13B is generated.

A method of manufacturing a structure of a desired shape on the print medium M using the first density image data and the second density image data generated in the image data generation process in FIG. 9 is described in detail below, by way of first to third embodiments.

First Embodiment

Figure 14:
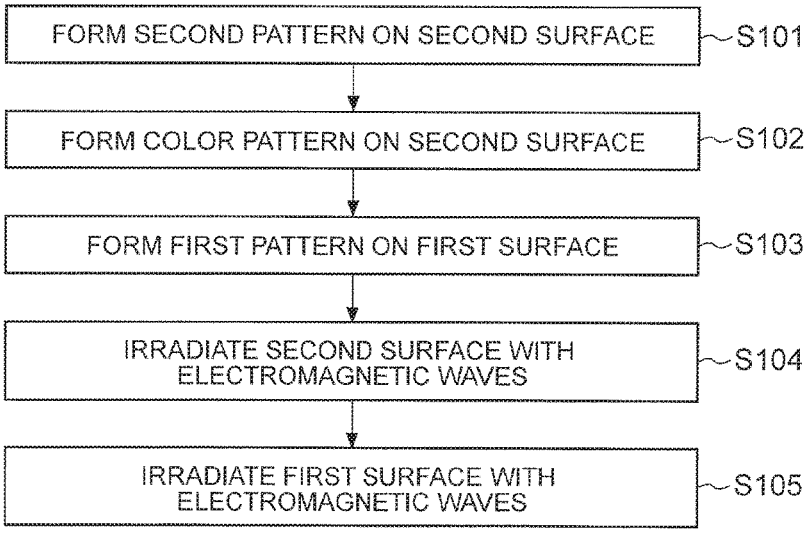
FIG. 14 is a flowchart of a three-dimensional structure formation process according to a first embodiment.

FIG. 14 is a flowchart of a three-dimensional structure formation process according to this embodiment. In this embodiment, the ink cartridge 43*k* in the printer 40 stores the ink of black K including carbon black. The ink of black K including carbon black is a material for absorbing electromagnetic waves and converting them into heat energy.

The structure manufacturing system 1 first forms the second pattern P2 on the second surface (surface FS) (step S101). Here, the user sets the print medium M on the printer 40 so that the surface FS faces the print head 42, and inputs an instruction to form the second pattern P2 to the computer 10. The computer 10 responsively generates the print data and print control data corresponding to the second density image data, and outputs the generated data to the printer 40. The printer 40 forms the second pattern P2 on the surface FS of the print medium M in the ink of black K, based on the print data and print control data. The printer 40 controls the print density by, for example, area coverage modulation.

The structure manufacturing system 1 further forms a color pattern on the second surface (surface FS) (step S102). Here, the user inputs an instruction to form the color pattern to the computer 10. The computer 10 responsively generates the print data and print control data corresponding to the color image data, and outputs the generated data to the printer 40. The printer 40 forms the color pattern on the surface FS of the print medium M in the color inks of cyan C, magenta M, and yellow Y, based on the print data and print control data. Black included in the color pattern is made by a color mixture of cyan C, magenta M, and yellow Y. The color inks of cyan C, magenta M, and yellow Y include no material for absorbing electromagnetic waves and converting them into heat energy, such as carbon black. Accordingly, even when the ink forming black made from the color mixture of these inks is irradiated with electromagnetic waves, the ink does not absorb the electromagnetic waves and convert them into heat energy. The pattern formations in steps S101 and S102 may be performed at the same time.

After forming the pattern on the second surface, the structure manufacturing system 1 forms the first pattern P1 on the first surface (surface BS) (step S103). Here, the user sets the print medium M on the printer 40 so that the surface BS faces the print head 42, and inputs an instruction to form the first pattern P1 to the computer 10. The computer 10 responsively generates the print data and print control data corresponding to the first density image data, and outputs the generated data to the printer 40. The printer 40 forms the first pattern P1 on the surface BS of the print medium M in the ink of black K, based on the print data and print control data.

This produces a processed medium in which the first pattern P1 is formed on the first surface with the material for converting electromagnetic wave energy into heat energy and the second pattern for complementing the first pattern is formed on the second surface with the material for converting electromagnetic wave energy into heat energy, as illustrated in FIG. 6A as an example. Simply irradiating the processed medium with electromagnetic waves under predetermined conditions makes it possible to manufacture a structure of a desired shape.

After this, the structure manufacturing system 1 irradiates the print medium M with electromagnetic waves from the second surface (surface FS) of the print medium M (step S104). Here, the user places the print medium M on which the pattern is formed, on the placement table 51 of the heater 50 in a state where the surface FS faces upward. The heater 50 then irradiates the surface FS of the print medium M uniformly with electromagnetic waves such as infrared. Hence, the ink of black K including carbon black forming the second pattern P2 is irradiated with electromagnetic waves, to generate heat. As a result, the region of the expansion layer M2 where the second pattern P2 is formed is heated to expand, and a complementary three-dimensional structure for complementing the edge part in the final three-dimensional structure is formed.

Lastly, the structure manufacturing system 1 irradiates the print medium M with electromagnetic waves from the first surface (surface BS) of the print medium M (step S105), and ends the three-dimensional structure formation process in FIG. 14. Here, the user places the print medium M on which the pattern is formed, on the placement table 51 of the heater 50 in a state where the surface BS faces upward. The heater 50 then irradiates the surface BS of the print medium M uniformly with electromagnetic waves such as infrared. Hence, the ink of black K including carbon black forming the first pattern P1 is irradiated with electromagnetic waves, to generate heat. As a result, the region of the expansion layer M2 corresponding to the first pattern P1 is heated through the base material M1 to expand.

According to this embodiment, it is possible to manufacture the structure E entirely having an approximately uniform height without a loss of sharpness in edge part. In other words, it is possible to increase the curvature of the cross-sectional shape in the part corresponding to the boundary region of the first pattern P1 in the structure to be manufactured, make the angular part of the cross-sectional shape closer to the right angle, or make the edge part sharper, as compared with the case where the second pattern P2 is not formed on the surface FS of the expansion layer M2.

Second Embodiment

Figure 15:
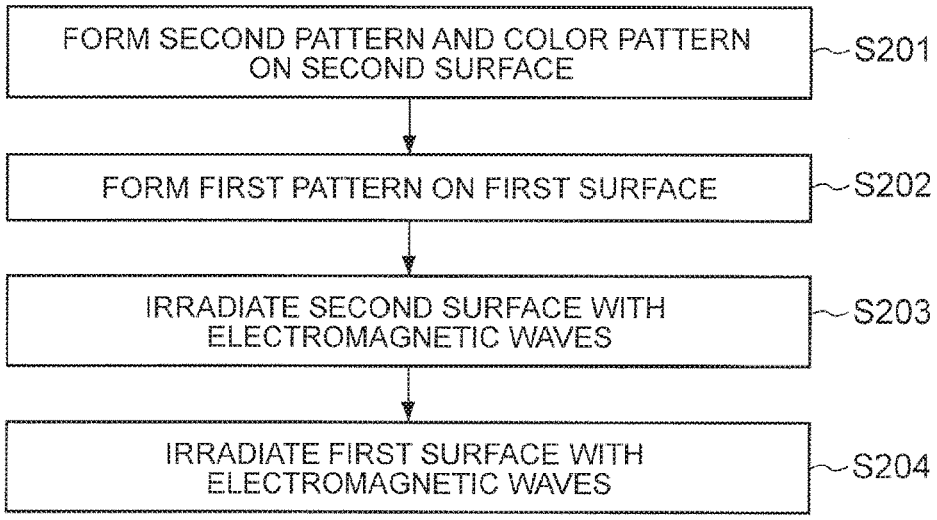
FIG. 15 is a flowchart of a three-dimensional structure formation process according to a second embodiment.

FIG. 15 is a flowchart of a three-dimensional structure forming process according to this embodiment. The structure manufacturing system 1 is used in this embodiment, too. This structure manufacturing system 1 includes, instead of the printer 40, a printer having not only the ink cartridge 43*k* storing the ink of black K including carbon black but also an ink cartridge 43*k*' storing ink of black K' not including carbon black.

The structure manufacturing system 1 first forms the second pattern P2 and the color pattern on the second surface (surface FS) (step S201). Here, the user sets the print medium M on the printer 40 so that the surface FS faces the print head 42, and inputs an instruction to form the second pattern P2 and the color pattern to the computer 10. The computer 10 responsively generates the print data and print control data corresponding to the second density image data and the color image data, and outputs the generated data to the printer 40. The printer 40 forms the second pattern P2 on the surface FS of the print medium M in the ink of black K and also forms the color pattern on the surface FS in the inks of cyan C, magenta M, yellow Y, and black K', based on the print data and print control data.

After forming the patterns on the second surface, the structure manufacturing system 1 forms the first pattern P1 on the first surface (surface BS) (step S202). Step S202 is the same as step S103 in FIG. 14. This produces a processed medium in which the first pattern P1 is formed on the first surface with the material for converting electromagnetic wave energy into heat energy and the second pattern for complementing the first pattern is formed on the second surface with the material for converting electromagnetic wave energy into heat energy, as illustrated in FIG. 6A as an example.

The structure manufacturing system 1 then irradiates the second surface (surface FS) with electromagnetic waves (step S203), irradiates the first surface (surface BS) with electromagnetic waves (step S204), and ends the three-dimensional structure formation process in FIG. 15. Steps S203 and S204 are the same as steps S104 and S105 in FIG. 14.

According to this embodiment, too, it is possible to manufacture the structure E entirely having an approximately uniform height without a loss of sharpness in edge part. In other words, it is possible to increase the curvature of the cross-sectional shape in the part corresponding to the boundary region of the first pattern P1 in the structure to be manufactured, make the angular part of the cross-sectional shape closer to the right angle, or make the edge part sharper, as compared with the case where the second pattern P2 is not formed on the surface FS of the expansion layer M2. Moreover, since black in the color pattern is represented by the ink of black K' not including carbon black in this embodiment, good coloration can be achieved while saving the ink consumption as compared with the case of representing black using cyan C, magenta M, and yellow Y.

Third Embodiment

Figure 16:
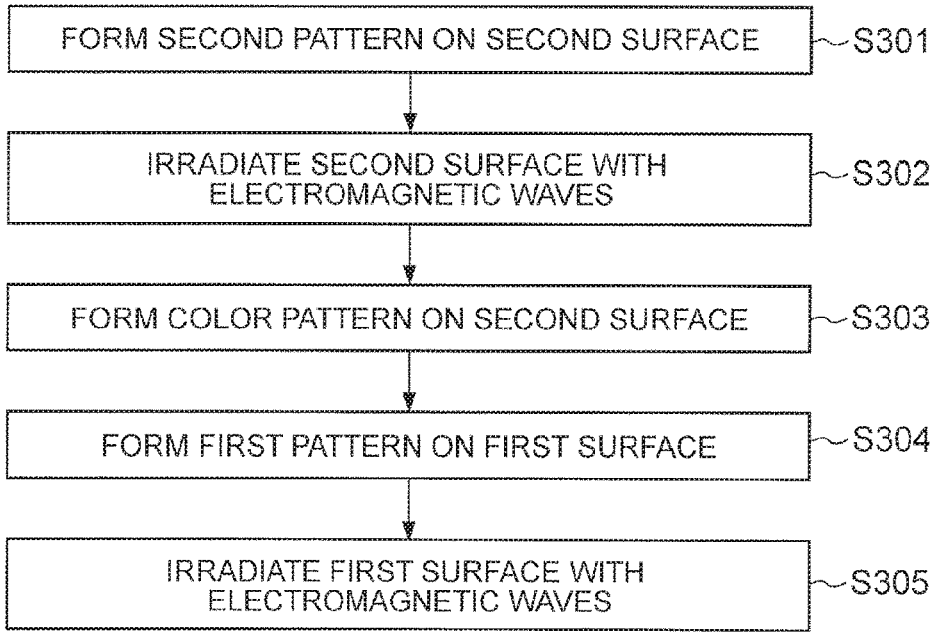
FIG. 16 is a flowchart of a three-dimensional structure formation process according to a third embodiment.

FIG. 16 is a flowchart of a three-dimensional structure forming process according to this embodiment. In this embodiment, too, the ink cartridge 43*k* in the printer 40 stores the ink of black K including carbon black.

The structure manufacturing system 1 first forms the second pattern P2 on the second surface (surface FS) (step S301). Step S301 is the same as step S101 in FIG. 14.

The structure manufacturing system 1 then irradiates the second surface (surface FS) with electromagnetic waves (step S302). Step S302 is the same as step S104 in FIG. 14.

The structure manufacturing system 1 then forms the color pattern on the second surface (surface FS) (step S303). Here, the user inputs an instruction to form the color pattern to the computer 10. The computer 10 responsively generates the print data and print control data corresponding to the color image data, and outputs the generated data to the printer 40. The printer 40 forms the color pattern on the surface FS of the print medium M in the inks of cyan C, magenta M, yellow Y, and black K, based on the print data and print control data.

In step S303, the three-dimensional structure corresponding to the second pattern is formed on the surface FS. This structure is, however, intended to complement the edge part of the three-dimensional structure formed by the below-mentioned first pattern, and so its maximum height is within a prescribed height. Accordingly, the structure does not obstruct the formation of the color pattern by the printer 40, and a decrease in printing quality hardly occurs.

After forming the color pattern on the second surface, the structure manufacturing system 1 forms the first pattern P1 on the first surface (surface BS) (step S304), irradiates the first surface (surface BS) with electromagnetic waves (step S305), and ends the three-dimensional structure formation process in FIG. 16. Steps S304 and S305 are the same as steps S103 and S105 in FIG. 14.

According to this structure, too, it is possible to manufacture the structure E entirely having an approximately uniform height without a loss of sharpness in edge part. In other words, it is possible to increase the curvature of the cross-sectional shape in the part corresponding to the boundary region of the first pattern P1 in the structure to be manufactured, make the angular part of the cross-sectional shape closer to the right angle, or make the edge part sharper, as compared with the case where the second pattern P2 is not formed on the surface FS of the expansion layer M2. Moreover, since black in the color pattern is represented by the ink of black K including carbon black in this embodiment, good coloration can be achieved while saving the ink consumption as compared with the case of representing black using cyan C, magenta M, and yellow Y.

The foregoing embodiments each show a specific example to help understanding the present invention, and the present invention is not limited to these embodiments. Various changes or modifications can be made to the structure manufacturing method, the processed medium, the data generation method, and the program without departing from the scope of the present invention as defined in the claims.

Although FIG. 3 illustrates the inkjet printer, the printer is not limited to an inkjet printer. Any printer such as a laser printer may be used. Although FIG. 4 illustrates the heater in which the light source unit moves relative to the print medium M, this is merely an example of the heater 50, and any heater that irradiates the print medium M uniformly with electromagnetic waves may be used. For example, the heater 50 may have the light source unit 54 fixed to the placement table 51 and further include a conveyance mechanism (not illustrated), where the conveyance mechanism conveys the print medium M so that the print medium M moves relative to the light source unit 54. Alternatively, the heater may include such a light source unit that irradiates the whole print medium M with electromagnetic waves simultaneously.

The procedure described in each of the foregoing embodiments is an example of the three-dimensional structure manufacturing procedure, and the order of steps may be changed. For example, although FIGS. 14 to 16 illustrate an example of forming the first pattern after the second pattern, the second pattern may be formed after the first pattern, or the two patterns may be formed simultaneously. FIGS. 14 to 16 illustrate an example of irradiating the material forming the second pattern with electromagnetic waves from the second surface before irradiating the material forming the first pattern with electromagnetic waves from the first surface. Regarding this point, it is desirable to perform the steps in the order described in the embodiments, that is, irradiating the first surface with electromagnetic waves after irradiating the second surface with electromagnetic waves. This is because the structure formed by the second pattern is smaller than the structure formed by the first pattern and so its shape tends to change with a change in the conditions (e.g. the state of the expansion layer M2 and the distance to the light source).

Although the above describes an example where the first pattern and the second pattern are formed with the same material, the material forming the first pattern and the material forming the second pattern may be any material for converting electromagnetic wave energy into heat energy. Accordingly, the first material forming the first pattern and the second material forming the second pattern may be different materials for converting electromagnetic wave energy into heat energy.

Although the above describes an example where the second pattern is at least a part of the outline part of the first pattern, the second pattern is not limited to the outline part of the first pattern. For example, in the case where there is a level difference in the first pattern, the second pattern may be at least a part of the level difference part. The level difference part is a part where the structure tends to be not sharp as with the outline part, and is preferably complemented to facilitate the effect of making the structure closer to the desired shape.

Although each of the foregoing embodiments describes the case where the first pattern P1 is a shading pattern entirely of uniform density, the first pattern P1 may be a shading pattern including a uniform density region of uniform density in a peripheral part including at least the boundary region. In this case, by forming the second pattern P2 in the part of the surface FS of the expansion layer M2 matching the peripheral edge of the first pattern P1 from among the peripheral edge of the uniform density region, a structure whose edge part is sharper can be manufactured. In other words, it is possible to increase the curvature of the cross-sectional shape in the part corresponding to the boundary region (peripheral edge) of the first pattern P1 in the structure to be manufactured, make the angular part of the cross-sectional shape closer to the right angle, or make the edge part sharper, as compared with the case where the second pattern P2 is not formed on the surface FS of the expansion layer M2.

What is claimed is:

1. A structure manufacturing method for manufacturing a structure provided with an unevenness on a surface thereof by expanding an expansion layer that is included in a print medium and expands by heating, the structure manufacturing method comprising:

a first forming step of forming a first pattern with a first material for converting electromagnetic wave energy into heat energy, on a first surface of the print medium; and a second forming step of forming a second pattern with a second material for converting electromagnetic wave energy into heat energy, on a second surface which is an opposite surface of the print medium to the first surface, the second pattern being a pattern for expanding the expansion layer to complement expansion of the expansion layer by the first pattern, wherein the first pattern is a shading pattern including a uniform density region having uniform density, and the second pattern is provided in a part of the print medium corresponding to a peripheral edge of the uniform density region.

2. The structure manufacturing method according to claim 1, wherein the second pattern formed in the second forming step is at least any one of:

(i) a pattern for increasing a curvature of a cross-sectional shape of the unevenness in a part corresponding to a boundary region of the first pattern;

(ii) a pattern for making an angular part of the cross-sectional shape in the part corresponding to the boundary region of the first pattern closer to a right angle; and (iii) a pattern for making an edge part of the unevenness in the part corresponding to the boundary region of the first pattern sharper.

3. The structure manufacturing method according to claim 1, wherein in a case where there is a level difference in the first pattern, a part of the level difference part is formed in the second forming step as the second pattern on the second surface.

4. The structure manufacturing method according to claim 1, wherein the second pattern formed in the second forming step is determined based on the print medium and the first pattern.

5. The structure manufacturing method according to claim 1, further comprising:

an irradiation step of irradiating the print medium with electromagnetic waves from the first surface and irradiating the print medium with electromagnetic waves from the second surface.

6. The structure manufacturing method according to claim 5, wherein in the irradiation step, irradiating the print medium with electromagnetic waves from the second surface precedes irradiating the print medium with electromagnetic waves from the first surface.

7. The structure manufacturing method according to claim 1, wherein the second pattern is formed on the second surface with black ink including carbon black, a color pattern is further formed on the second surface with color inks, after the color pattern is formed, the first pattern is formed on the first surface with the black ink, and after the first pattern is formed on the first surface, the print medium is irradiated with electromagnetic waves from the second surface and then from the first surface.

8. The structure manufacturing method according to claim 1, wherein the second pattern is formed on the second surface with black ink including carbon black and a color pattern is formed on the second surface with color inks, after the color pattern is formed, the first pattern is formed on the first surface with the black ink, and after the first pattern is formed on the first pattern with the black ink, the print medium is irradiated with electromagnetic waves from the second surface and then from the first surface.

9. The structure manufacturing method according to claim 1, wherein the second pattern is formed on the second surface with black ink including carbon black, after that, the print medium is irradiated with electromagnetic waves from the second surface, after the print medium is irradiated with electromagnetic waves from the second surface, a color pattern is formed on the second surface with color inks, and after the color pattern is formed, the first pattern is formed on the first surface with the black ink, and the print medium is irradiated with electromagnetic waves from the first surface.

10. The structure manufacturing method according to claim 1, the print medium being a stack of the thermal expansion layer, and a distance between the second surface and the thermal expansion layer being smaller than a distance between the first surface and the thermal expansion layer, wherein the second forming step precedes the first forming step.

11. The structure manufacturing method according to claim 1, the first material and the second material being black ink including carbon, wherein the first pattern and the second pattern are respectively formed with the black ink in the first forming step and in the second forming step.

12. The structure manufacturing method according to claim 1, wherein the second pattern is formed in the second step in a narrower range than the first pattern.

13. The structure manufacturing method according to claim 1, comprising:

an obtaining step of obtaining a height of the structure to be formed, based on a density of a first material forming the first pattern;

a determining step of determining whether to form the second pattern, based on the obtained height and a width of the first pattern; and the second pattern forming step of reading, in a case where it is determined in the determining step to form the second pattern, gray scale data for forming the second pattern from a storage means and forming the second pattern.

14. A structure manufacturing method for manufacturing a structure by expanding an expansion layer that is included in a print medium and expands by heating, the structure manufacturing method comprising:

a second forming step of forming a second pattern with a second material for converting electromagnetic wave energy into heat energy, on a second surface which is an opposite surface of the print medium to a first surface, the second pattern being a pattern for expanding the expansion layer to complement expansion of the expansion layer by a first pattern provided to the first surface; and a first forming step of forming the first pattern with a first material for converting electromagnetic wave energy into heat energy, on the first surface of the print medium which is an opposite surface of the print medium to the second surface, wherein the first pattern is a shading pattern including a uniform density region having uniform density, and the second pattern is provided in a part of the print medium corresponding to a peripheral edge of the uniform density region.

15. The structure manufacturing method according to claim 14, wherein the second pattern formed in the second forming step is a pattern that complements a difference between a shape of a structure to be formed as specified by the first pattern and a shape of a structure manufactured by expanding the expansion layer through irradiation with electromagnetic waves from the first surface.

16. The structure manufacturing method according to claim 14, wherein the second pattern is formed in the second forming step so that an edge part of a cross-sectional shape of the structure that is formed on the second surface as specified by the first pattern is made sharper.

* * * * *